US008063564B2

(12) United States Patent
Kostrun et al.

(10) Patent No.: US 8,063,564 B2
(45) Date of Patent: Nov. 22, 2011

(54) STARTING AID FOR HID LAMP

(75) Inventors: Marijan Kostrun, Tolland, CT (US); Helmar Adler, Danvers, MA (US)

(73) Assignee: Osram Sylvania Inc., Danvers, MA (US)

( * ) Notice: Subject to any disclaimer, the term of this patent is extended or adjusted under 35 U.S.C. 154(b) by 185 days.

(21) Appl. No.: 12/476,392

(22) Filed: Jun. 2, 2009

(65) Prior Publication Data

US 2009/0322224 A1 Dec. 31, 2009

Related U.S. Application Data

(60) Provisional application No. 61/075,765, filed on Jun. 26, 2008.

(51) Int. Cl.
*H01J 17/44* (2006.01)

(52) U.S. Cl. ..... 313/594; 313/607

(58) Field of Classification Search ..... 313/574, 313/594, 607

See application file for complete search history.

(56) References Cited

U.S. PATENT DOCUMENTS

| | | | | |
|---|---|---|---|---|
| 3,714,494 | A | 1/1973 | Nakamura | |
| 3,715,622 | A | 2/1973 | Page et al. | |
| 4,010,397 | A | 3/1977 | Hon | |
| 4,322,658 | A | 3/1982 | Minarczyk | |
| 4,328,445 | A | 5/1982 | Van Den Plas et al. | |
| 4,445,073 | A | 4/1984 | Wyner et al. | |
| 5,323,091 | A | 6/1994 | Morris | |
| 5,355,053 | A | 10/1994 | Zhu | |
| 5,550,421 | A | 8/1996 | Scholz et al. | |
| 5,959,404 | A | 9/1999 | Nortrup et al. | |
| 6,054,810 | A * | 4/2000 | Yamamoto et al. | 313/607 |
| 6,198,223 | B1 | 3/2001 | Scholz | |
| 6,201,348 | B1 | 3/2001 | Nortrup et al. | |
| 6,222,320 | B1 * | 4/2001 | Stockwald | 315/48 |
| 6,268,698 | B1 | 7/2001 | Scholz | |
| 6,727,649 | B1 * | 4/2004 | Yano et al. | 313/607 |
| 6,741,034 | B2 | 5/2004 | Scholz | |
| 6,906,462 | B1 | 6/2005 | Gorille | |

(Continued)

OTHER PUBLICATIONS

U.S. Appl. No. 12/146,485, filed Jun. 26, 2008.

*Primary Examiner* — Vip Patel

(74) *Attorney, Agent, or Firm* — Robert F. Clark; Andrew Martin

(57) ABSTRACT

An arc discharge light source (10) comprises a translucent body (12) having a hollow center 14 and oppositely disposed ends (16, 18). A cathode lead-in 20 is positioned in one of the ends (16) and terminates at a first end (22) in a cathode electrode (24) within the hollow center (14) and a second end (26) in a connector (28) for a power supply. An anode lead-in 30 is positioned in the other of the ends (18) and terminates at a first end (32) in an anode electrode (34) within the hollow center (14) and at a second end (36) in a connector (40) for a power supply. A space (42) between the cathode electrode (24) and the anode electrode (34) within the hollow center (14) defines an arc gap. An arc generating and sustaining medium (43) is provided within the hollow center (14) and a starting aid (41) comprising an auxiliary electrode (44) substantially surrounds the anode electrode (34) and is positioned solely on the external surface (46) of the body (12) and is electrically connected to the cathode lead-in (20).

4 Claims, 3 Drawing Sheets

U.S. PATENT DOCUMENTS 6,982,526 B2 1/2006 Schallmoser
7,038,383 B2 5/2006 Butler et al.
7,057,345 B2 * 6/2006 Kikuchi et al. ..... 313/595
7,187,131 B2 3/2007 Budinger
7,355,346 B1 * 4/2008 Chen et al. ..... 313/607
2002/0158580 A1 10/2002 Uemura et al.

* cited by examiner

STARTING AID FOR HID LAMP

TECHNICAL FIELD

This invention relates to arc discharge light sources and more particularly to starting aids therefor. Still more particularly, it relates to starting aids relying on a dielectric barrier discharge (DBD) and the generation of vacuum ultraviolet photons (VUV).

BACKGROUND ART

High intensity arc discharge vessels employed as light sources are a viable option for producing efficient illumination and they have been used as such for many years. Basically, they come in two forms, usually designated low-pressure or high-pressure depending upon their construction. As a general rule, low-pressure light sources use argon as a part of the arc-generating and sustaining medium. Because these light sources use electrodes defining an arc gap between them they must employ a ballast of one kind or another to control the power flow during two extreme conditions; that is, before starting, the device presents a condition similar to an open circuit and after starting a condition tantamount to a short-circuit.

Because of the unique starting requirements, it has often been the case that a starting aid of one kind or another has been used to help in initiating the start of the arc. With respect to initiating a DBD the starting aids are comprised of two basic types: those that create the DBD in the arc chamber and those that create the DBD outside of the arc chamber. An example of the former is shown in U.S. Pat. No. 3,715,622 and an example of the latter is shown in U.S. Pat. No. 6,222,320. Additionally, a specific form of the latter uses what is termed a "bubble in the press." Such aids are shown, for example, in U.S. Pat. Nos. 5,323,091 and 5,959,404, both of which are assigned to the assignee of the instant invention. These latter two techniques do create a DBD within the bubble; however, its photons have to travel through the quartz vessel to reach the main electrodes inside the discharge vessel and the quartz absorbs most of the UV radiation, which decreases considerably the effectiveness of the starting aid. Additionally, the DBD in the bubble occurs behind the cathode so there is a visibility problem which limits the effectiveness of this particular starting aid. Also, as a part of the starting aid, a molybdenum foil with sharp edges is used. Because of the sharp edges which promote the electron emission, the foil operates better as a cathode than as an anode. Also, because of the small volume of the bubble, there are few free electrons on the wall of the bubble that would allow the foil to operate as an anode. On the other hand, in the bubble using the foil as a cathode can lead to its deterioration as the foil is exposed to strong ion bombardment during the ignition phase.

Yet another technique is shown in U.S. Pat. No. 6,201,348 wherein the starting aid comprises a return wire forming a coil at the base of a lamp, and creates a low pressure DBD in the buffer gas in the outer jacket. First, the DBD produced is diffuse and is created far from the cathode. Second, the photons generated by the DBD have to travel through the wall of the discharge vessel (which is made of quartz) and can be absorbed, thus decreasing its utility.

While all of these various techniques have proved workable, they still provide suboptimal solution to the problem of reliable ignition and are expensive and/or difficult to fabricate.

DISCLOSURE OF INVENTION

It is, therefore, an object of the invention to obviate the disadvantages of the prior art.

It is another object of the invention to improve starting aids.

It is yet another object of the invention to enhance starting aids.

These objects are accomplished, in one aspect of the invention, by the provision of an arc discharge light source comprising: a translucent body having a hollow center and oppositely disposed ends; a cathode lead-in positioned in one of the ends terminating at a first end in a cathode electrode within the hollow center and a second end in connector for a power supply. An anode lead-in is positioned in the other of the ends and terminates at a first end in an anode electrode within the hollow center and at a second end in a connector for a power supply. A space between the cathode electrode and the anode electrode within the hollow center defines an arc gap. An arc generating and sustaining medium is provided within the hollow center; and an auxiliary electrode substantially surrounds the anode and is positioned solely on the external surface of the hollow center and is electrically connected to the cathode lead-in.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
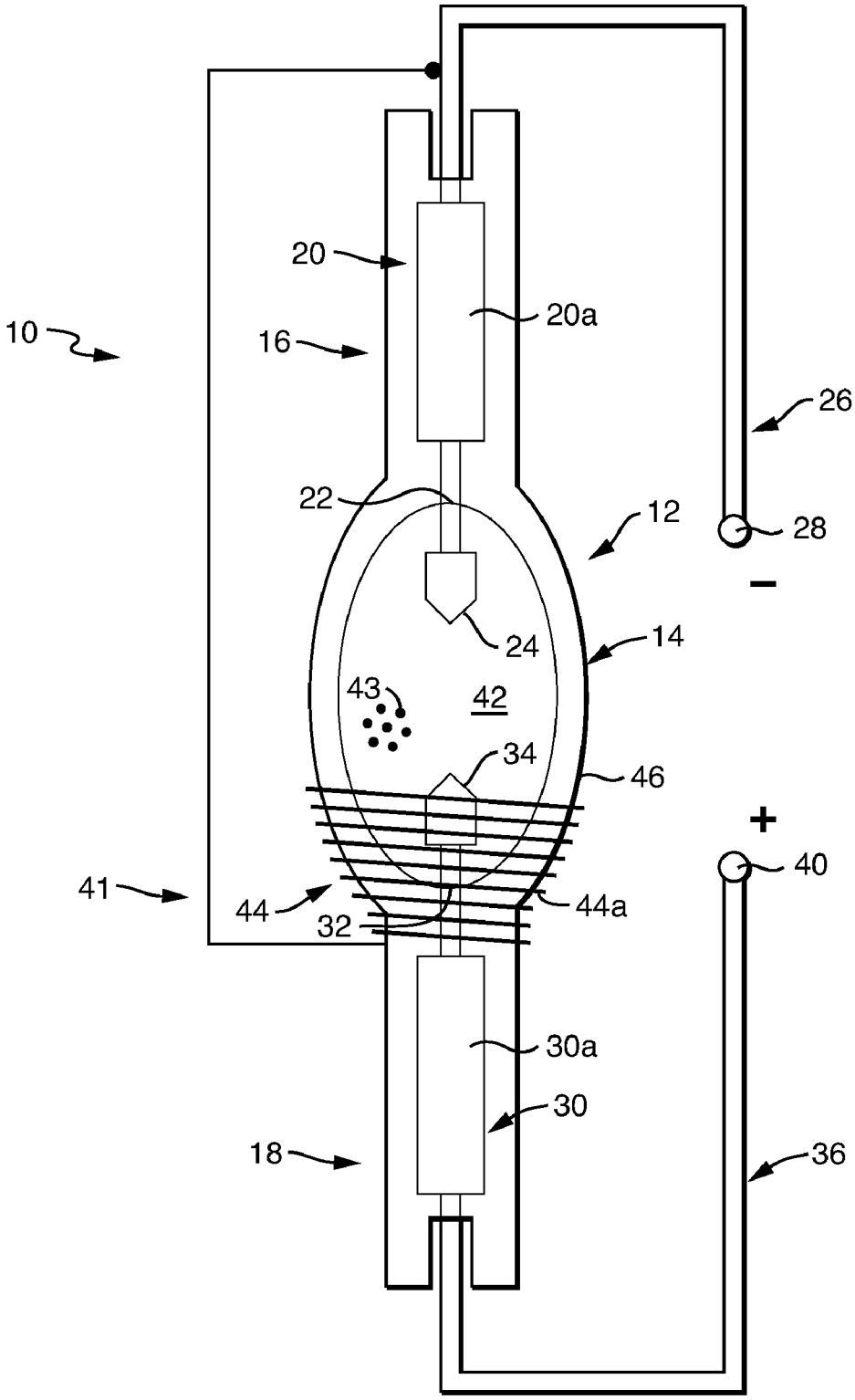
FIG. 1 is an elevation view of an embodiment of the invention.

Referring now to the drawings with greater particularity, there is shown in FIG. 1 an arc discharge light source 10 comprising a translucent body 12 having a hollow center 14 and oppositely disposed ends 16, 18. The body 12 is preferably formed of quartz.

A cathode lead-in 20 is positioned in end 16 and terminates at a first end 22 in a cathode electrode 24 within the hollow center 14 and a second end 26 in a connector 28 for a power supply. An anode lead-in 30 is positioned in the other end 18 and terminates at a first end 32 in an anode electrode 34 within the hollow center 14 and at a second end 36 in a connector 40 for a power supply. Typically, the cathode electrode and the anode electrode are tungsten and are fixed to a molybdenum foil, 20*a*, 30*a* respectively, which foil is sealed into the quartz ends. A space 42 exists between the cathode electrode 24 and the anode electrode 34 within said hollow center 14 and defines an arc gap.

An arc generating and sustaining medium 43 is provided within the hollow center 14 as is known.

A starting aid 41 comprising an auxiliary electrode 44 that substantially surrounds the anode electrode 34 and is positioned solely on the external surface 46 of the body 12 and is electrically connected to the cathode lead-in 20.

Figure 2:
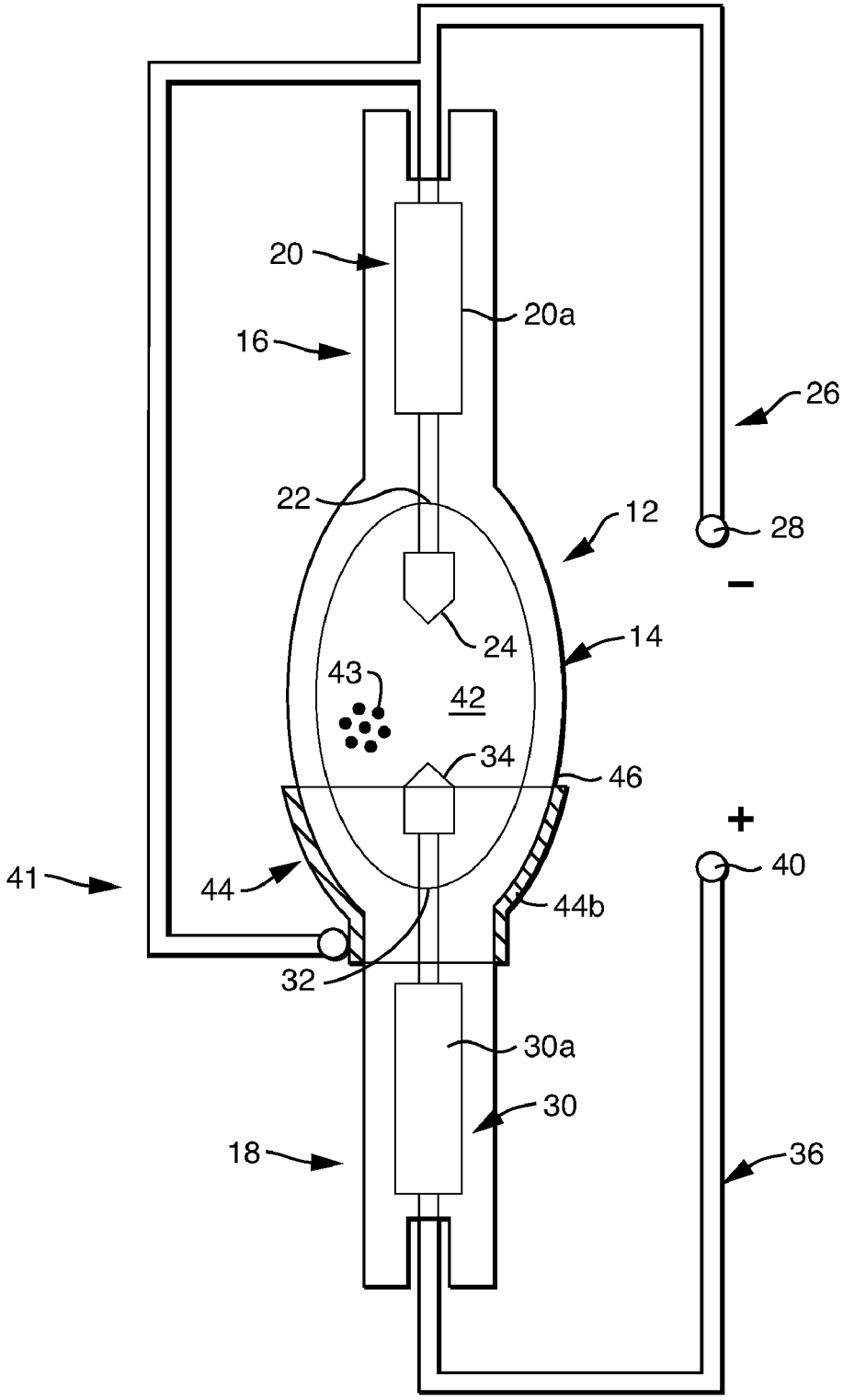
FIG. 2 is a similar view of an alternate embodiment of the invention.

As shown in FIG. 1 the auxiliary electrode 44 comprises a wire winding 44*a* of at least two turns and as shown in FIG. 2 the auxiliary electrode 44 comprises a sheath-like electrical conductor 44*b*. When the light source is intended for use as a projection light source, the electrical conductor 44*b* can be opaque and can be metal or an electrically conductive coating.

Figure 3:
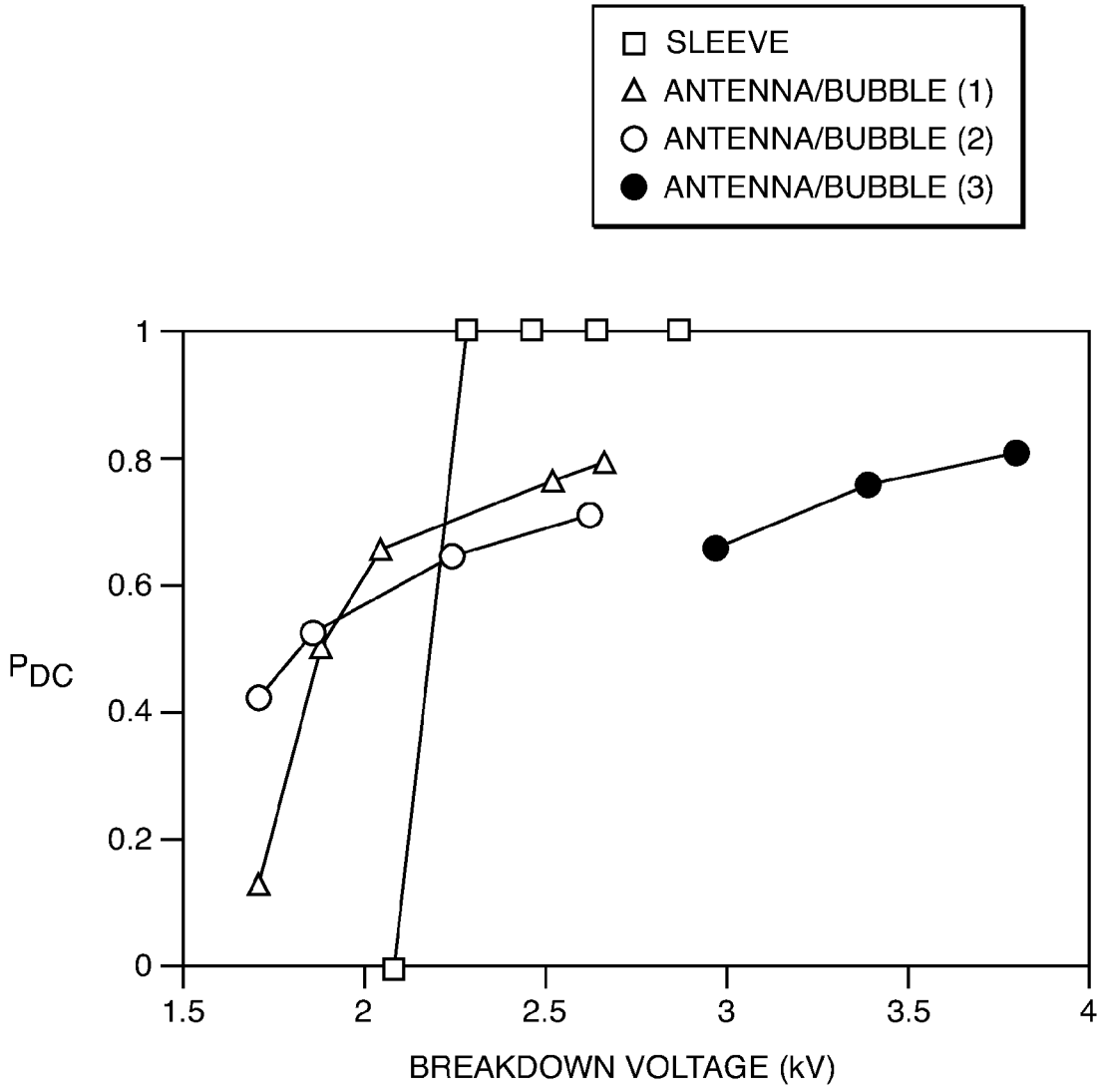
FIG. 3 is a graph depicting the advantage of the invention over prior art devices.

The results of the utilization of the instant invention relative to several versions of the prior art are illustrated graphically in FIG. 3 wherein the X-axis shows the Breakdown Voltage in kV and the Y-axis shows the Ignitability $P_{DC}$ (the probability of ignition given an ability to wait infinitely long for ignition) for different voltages as a function of the starting aid used. The solid line connecting the "squares" illustrates the starting aid of the invention while the remaining three, illustrated by the "triangle", "open circle" and "closed circle" show different versions of the "bubble" technique. It will be seen that utilization of the starting aid of the invention (i.e., the auxiliary electrode sleeve 44) gains an ignitability of 100% while the prior art techniques at best yield 80%. In all cases a DBD produces UV and VUV photons, which induces the breakdown between the main electrodes; however, with the instant invention a much greater efficiency is achieved because the DBD is created in full view of the cathode, and not behind the anode.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An arc discharge light source comprising:

a translucent body having a hollow center and oppositely disposed ends;

a cathode lead-in positioned in one of said ends terminating at a first end in a cathode electrode within said hollow center and a second end in connector for a power supply;

an anode lead-in positioned in the other of said ends and terminating at a first end in an anode electrode within said hollow center and at a second end in a connector for a power supply;

a space between said cathode electrode and said anode electrode within said hollow center defining an arc gap;

an arc generating and sustaining medium within said hollow center; and a starting aid comprising an auxiliary electrode substantially surrounding said anode and positioned solely on the external surface of said translucent body and being electrically connected to said cathode lead-in.

2. The arc discharge light source of claim 1 wherein said auxiliary electrode comprises a wire winding including at least two turns.

3. The arc discharge light source of claim 1 wherein said auxiliary electrode comprises a sheath-like electrical conductor.

4. The arc discharge light source of claim 3 wherein said sheath-like electrical conductor comprises an electrically conductive coating.

* * * * *